United States Patent [19]

Fukumoto et al.

[11] Patent Number: 5,048,879

[45] Date of Patent: Sep. 17, 1991

[54] DOOR LOCK FOR AN AUTOMOBILE

[75] Inventors: Ryoichi Fukumoto, Nagoya; Tetsuya Arao, Anjo, both of Japan

[73] Assignee: Aisin Seiki Kabushiki Kaisha, Japan

[21] Appl. No.: 631,701

[22] Filed: Dec. 24, 1990

[30] Foreign Application Priority Data

Dec. 27, 1989 [JP] Japan ..... 1-149331[U]
Dec. 27, 1989 [JP] Japan ..... 1-149332[U]

[51] Int. Cl.[5] ..... E05C 3/26
[52] U.S. Cl. ..... 292/216; 292/337; 292/DIG. 61; 292/DIG. 64
[58] Field of Search ..... 292/216, 280, DIG. 61, 292/337, DIG. 64

[56] References Cited

U.S. PATENT DOCUMENTS

| | | | |
|---|---|---|---|
| 3,400,961 | 9/1968 | Koch et al. | 292/216 |
| 3,415,559 | 12/1968 | Jeovons | 292/216 |
| 3,876,238 | 4/1975 | Watermann | 292/216 |
| 4,097,078 | 6/1978 | Tack et al. | 292/216 |
| 4,988,135 | 1/1991 | Ottino | 292/216 X |

*Primary Examiner*—Richard E. Moore
*Attorney, Agent, or Firm*—Finnegan, Henderson, Farabow, Garrett & Dunner

[57] ABSTRACT

A door lock for an automobile includes a wall facing a column which supports a pawl for detenting a rotary latch, a coil spring which is placed around the column. One end of the coil spring is supported by a first supporting portion of a housing. The other end of the coil spring is supported by a second supporting portion of a wall and is connected to the pawl. The column includes a connecting portion which projects from the column to limit movement of the coil spring.

2 Claims, 4 Drawing Sheets

DOOR LOCK FOR AN AUTOMOBILE

BACKGROUND OF THE INVENTION

1. Field of the Invention

This invention relates to a door lock for an automobile, especially to a housing of a door lock.

2. Description of Prior Art

A conventional door lock comprises a metal housing made by press process, a latch, a pawl, a striker engageable to the latch, a spring enforcing the latch for releasing from the striker and a spring enforcing the pawl for engaging to the latch.

In accordance with the operation of an outside handle or an inside handle, an open lever which connects with the handle presses the pawl and releases the engagement of the latch with the pawl to allow the door to open. On the other hand, when the door is closing the striker moves the latch rotating, while the latch is pressing the pawl. When the latch reaches a certain point, the latch engages to the pawl. The door lock can be locked by a key cylinder or a lock knob to release the connections between the open lever and the pawl. This is so called "locked" since the door is prevented from opening by the operations of the outside handle or the inside handle. When the key cylinder or the lock knob is operated for unlock, the open lever connects with the pawl so that the engagement of the latch and the pawl is released. The door is ready for opening.

The pawl works for engaging and releasing the latch with the help of the spring. The pawl is placed in the door lock housing to be allowed its rotation and is connected to the spring which is connected to the housing.

Thus, it is important for a door lock that the spring gives a certain force to the pawl. The spring is installed in the housing, however, it is difficult to assemble a spring into a small housing. There may be an uneven force applied to pawl by a spring because of a difficulty of assembly. This may cause a lack of the stability of the pawl movements. Further, a coil spring may be unstable in its position because of its shape, a coil spring may be assembled incorrectly in its position. This may also cause a bad response of the pawl and the latch movements.

SUMMARY OF A PREFERRED EMBODIMENTS OF THE INVENTION

An object of the present invention is to provide a door lock having improved the above-mentioned drawbacks, especially to provide a door lock which can be assembled with a spring easier.

Other objects will be apparent from an understanding of the invention.

In accordance with this invention, a door lock for an automobile includes a wall facing a column which supports a pawl, a coil spring which is placed around the column. One end of the coil spring is supported by a first supporting portion of a housing. The other end of the coil spring is supported by a second supporting portion of the wall and is connected to the pawl.

In accordance with this invention, when the pawl moves, the one end of the coil spring presses the first support portion so that the spring force is transmitted to the pawl. Also, it is easy to set the coil spring in the housing, because the both ends of the coil spring are guided by the wall when the coil spring is inserted onto the column.

In accordance with this invention, a door lock further includes a connecting portion which projects from the column. The connecting portion limits the movement of the coil spring when the pressure is given to the coil spring by the wall of the housing. The connecting portion also prevents the coil spring from moving off of the column.

BRIEF DESCRIBED OF THE DRAWINGS

The objects and advantages of the invention will become apparent from the following detailed description of preferred embodiment thereof in connection with the accompanying drawing in which.

DETAILED DESCRIPTION OF A PREFERRED EMBODIMENT OF THE INVENTION

Figure 1:
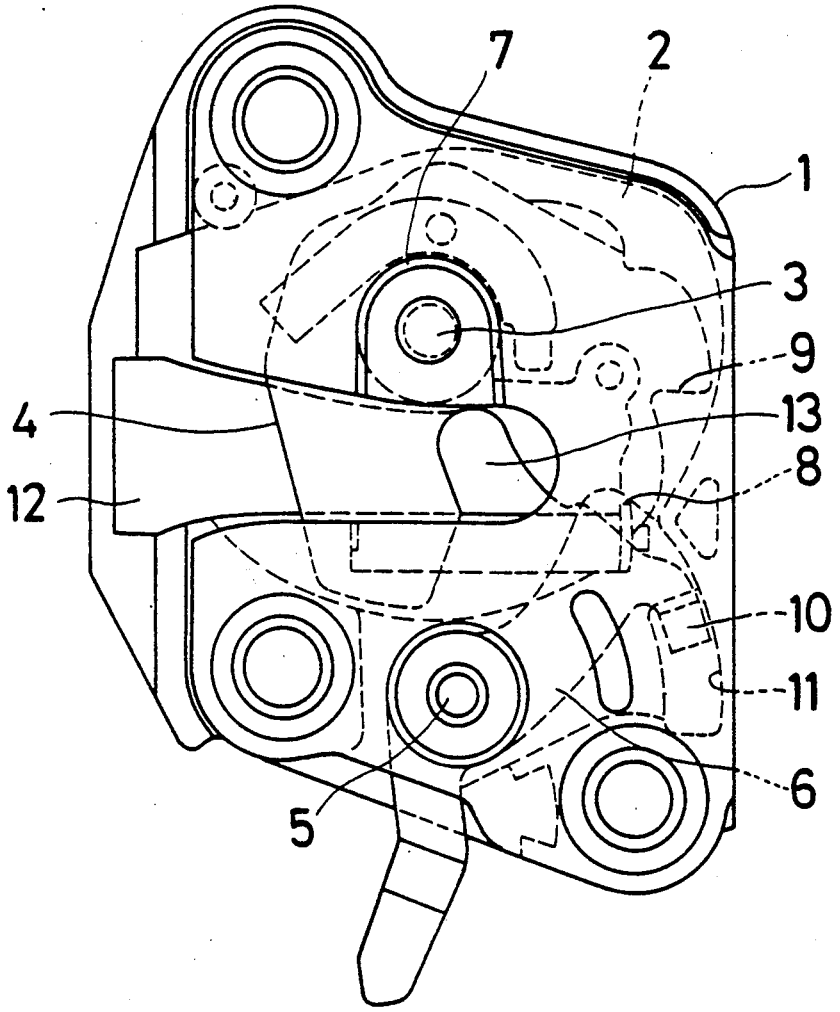
FIG. 1 is a drawing which shows a bottom view of a door lock in accordance with the present invention.

As shown in the FIG. 1, a synthetic resin housing 1 has an opening. A metal plate 2 is attached to the opening of the housing 1. In the housing 1, a latch 4 is mounted on a latch pin 3 so that the latch 4 rotates around the latch pin 3. A pawl 6 is mounted on a pawl pin 5 so that the pawl 6 rotates around the pawl pin 5. The latch 4 is enforced by a spring 7 toward the counter clockwise direction in FIG. 1. The latch 4 has faces 8, 9 which engage to the pawl 6 during the opening and closing of the door.

The pawl 6 is enforced by a spring mentioned later toward the counter clockwise direction in FIG. 1 and is able to engage to the latch 4. A column 10 provided on the pawl 6 projects out of the housing 1 through an opening 11 of the housing 1. The projected portion of the column 10 is connected to an open lever (not shown). When the open lever moves the column 10 along the opening 11 against the spring force, the engagement of the pawl 6 and the latch 4 is released.

A slit 12 made by the housing 1 and the plate 2 is provided for the striker (not shown). When the striker goes into the slit 12, the striker fits into a reception 13 of the latch 4. The the striker pushes the latch 4 to rotate around the pin 3 until the latch reaches the locking position as shown in FIG. 1.

Figure 2:
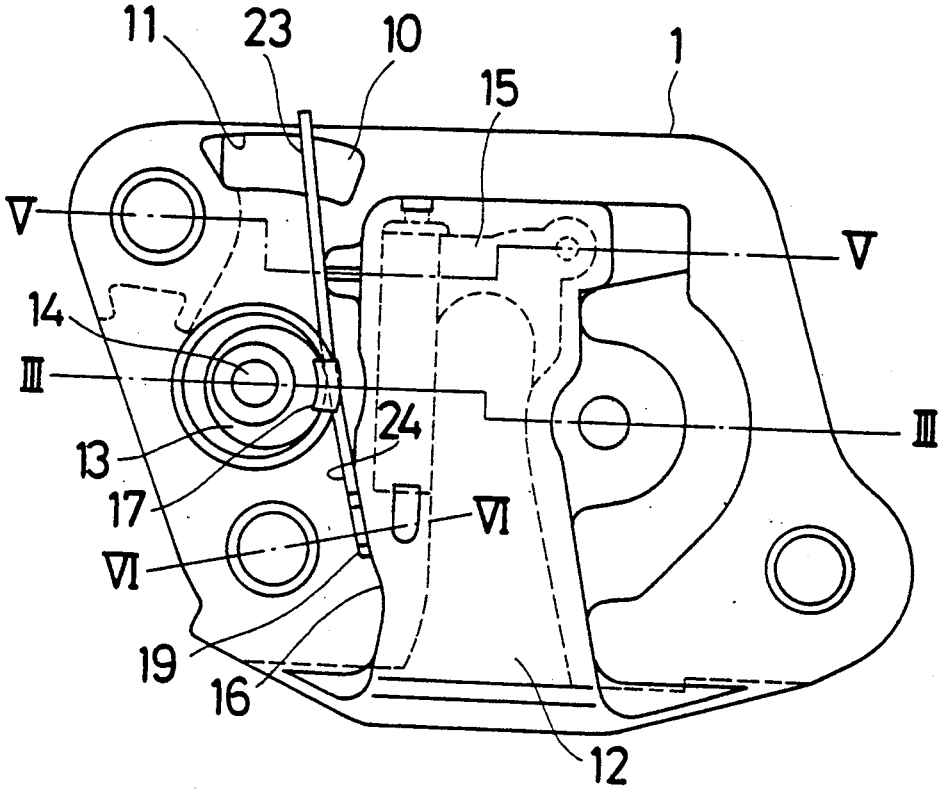
FIG. 2 is a drawing which shows a plan view of the door lock in FIG. 1.
Figure 3:
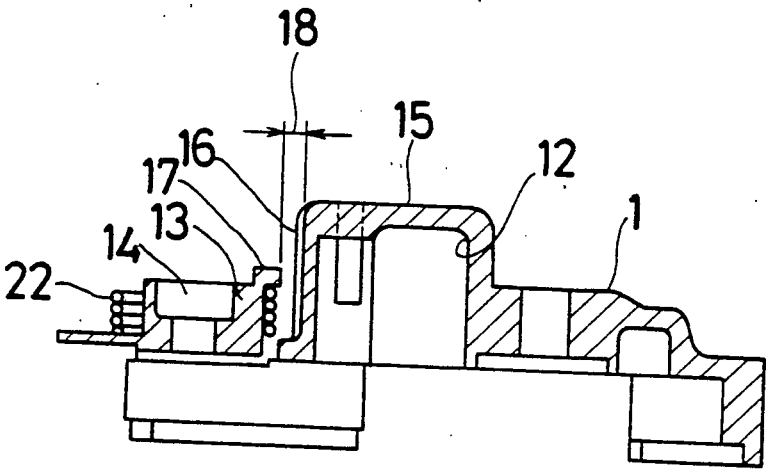
FIG. 3 is a drawing which shows a cut view along with the line III—III of the door lock in FIG. 2.
Figure 4:
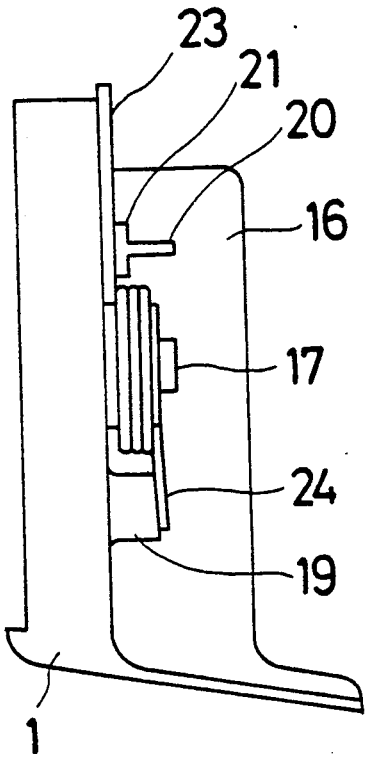
FIG. 4 is a drawing which shows a side view of the door lock in FIG. 3.
Figure 6:
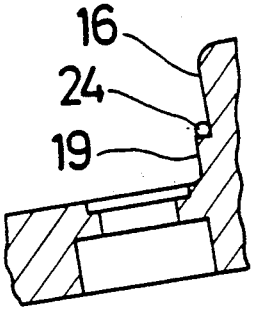
FIG. 6 is a drawing which shows a cut view along with the VI—VI line of the door lock in FIG. 2.
Figure 5:
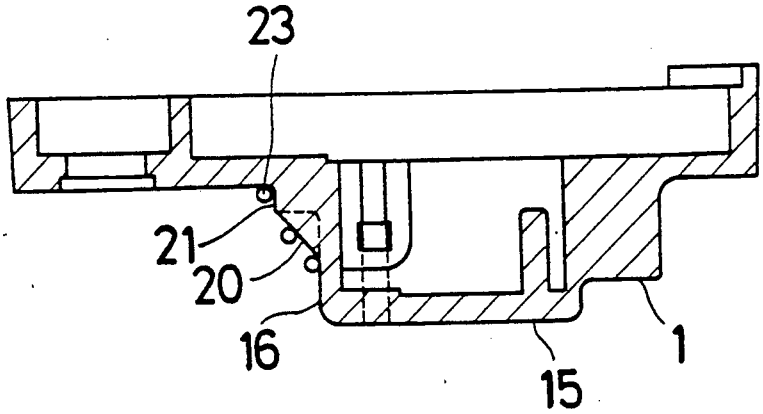
FIG. 5 is a drawing which shows a cut view along with the line V—V of the door lock in FIG. 2.

Referring to FIGS. 2 and 3, a cylindrical column 13 which supports the pawl pin 5 is projected out of the housing 1. The center of a hole which receives the pawl pin 5 is off set from the center of the column 13. At the center portion of the housing 1, a raised wall 15 is provided to make the slit 12. The side wall of the raised wall 15 faces the column 13. The column 13 has a thicker wall portion on this side. At the top of the column 13, a connecting portion 17 is provided to project toward the side wall 16 of the raised wall 15. The portion 17 projects to the side wall 16 is slightly longer than the diameter of the spring coil. On a side of the side wall 16, a support portion 19 is provided and is projected higher than the diameter of the spring coil. On the other side of the side wall 16, a guide slope 20 and the support portion 21 are provided. The support portion 21 projects from the side wall 16 and supports a spring mentioned later which contacts the column 10 of the pawl 6 so that the space between the end of the spring and the column 10 will be minimized.

A coil spring 22 which enforces the pole 5 toward one direction has an inner diamter which is larger than the outer diameter of the column 13 and a height which is the same as the height of the column 13. Both ends 23, 24 of the spring 22 extend out of the column 13 along the side wall 16.

When the coil spring 22 is assembled, the coil spring 22 is inserted through a gap 18 to set around the column 13. The end 23 of the spring 22 slides on the guide slope 20 to set the position. When the end 23 of the spring 22 reaches the support portion 21, the coil spring 22 is set around the column 13 and the other end 24 of the coil spring 22 sits on the support portion 19. The end 24 of the coil spring 22 is stopped at the position of the support portion 19. Both ends 23, 24 of the coil spring 22 contact the side wall 16 and the support portion 21. Thus, the coil spring 22 is pressed by the column 13 as shown in FIG. 3. The end 23 of the coil spring 22 is across over the hole 11 and leaves a space for the column 10 to be inserted into the hole 11. The column 10 is inserted into the hole 11 through this space and presses the end 23 of the coil spring 22 toward the column 10. It is easy to assemble the pawl 6 onto the housing 1. There is no space between the pawl 6 and the coil spring 22. This prevents noises. When the column 10 of the pawl 6 contacts the end 23 of the spring 22, the contact between the end 23 of the spring 22 and the support portion 21 is released. This also prevents noises because of no contacts between two parts.

An open link (not shown) contacts the column 10 on the other side of the end 23 of the coil spring 22 so that the end 23 of the coil spring 22 does not bother the movement of the open link. When the bottom end 23 of the coil spring 22 is pressed by the column 10, the other end 24 of the coil spring 22 tries to move downward. This movement of the end 24 of the coil spring 22 is stopped by the support portion 19 to keep the coil spring in correct position.

The housing 1 is made in one body with the support portions 19 and 21. In accordance with a door lock of the present invention, the spring which forces the pawl is placed outside of the housing and also is supported by the column made in one body of the housing. Therefore, there is no problems caused by the frictions or rusting of the metal parts. Thus, the maximum effects of the spring can be used. It is also easy to assemble the coil spring to the housing so that the automated assembly can be achieved. There is no frictions between the spring and raised wall when the pawl is set, thus the noise of closing the door can be reduced.

The one end of the spring sits on the support portion and the downward movement is limited. This allows the other end of the spring to move upward to prevent the contacts between the open link and the spring. This is effective to prevent malfunctions such as the locked position changing into the unlocked position unexpectedly.

Figure 7:
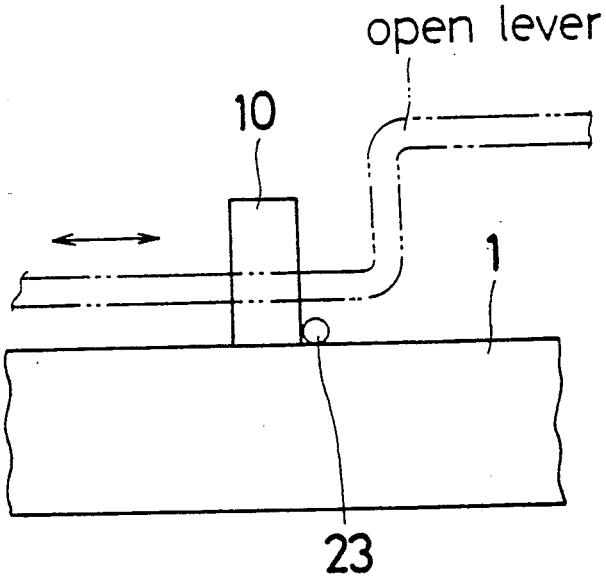
FIG. 7 is a drawing which shows a side view of the door lock when the open lever is operated while the door lock is locked.

It is recommended to move the open lever over the end of the spring when it is locked in order to prevent the malfunction as shown in FIG. 7.

Although the invention has been described in connection with preferred embodiments thereof, it will be appreciated by those skilled in the art, additions, substitutions, modifications, and deletions not specifically described, may be without departing from the spirit and scope of the invention as defined in the appended claims.

What is claimed is:

1. A door lock for an automobile comprising:
a housing,
a latch placed in said housing,
a pawl engageable to said latch,
a slit made in said housing,
a column made in one body with said housing,
a wall portion facing said column and defining said slit,
a coil spring placed around said column,
a first support portion (19) supporting one end of said coil spring,
a second support portion (21) supporting the other end of said coil spring which is connected to said pawl.

2. A door lock for an automobile comprising:
a housing,
a latch placed in said housing,
a pawl engageable to said latch,
a slit made in said housing,
a column made in one body with said housing,
a connecting portion (17) projected from said column,
a wall portion facing said column and defining said slit, and
a coil spring placed around said column, and between said connecting portion and said wall, wherein said connecting portion limits the movement of said coil spring when the coil spring receives the pressure by said wall so the inner side of said coil spring contacts the outer surface of said column.

* * * * *